US005841063A

United States Patent [19]

Hellkvist et al.

[11] Patent Number: 5,841,063

[45] Date of Patent: Nov. 24, 1998

[54] CASED AMMUNITION

[75] Inventors: Dan Hellkvist, Degerfors; Erik Loinder, Karlskoga, both of Sweden

[73] Assignee: Bofors AB, Karlskoga, Sweden

[21] Appl. No.: 704,742

[22] PCT Filed: Mar. 7, 1995

[86] PCT No.: PCT/SE95/00239

§ 371 Date: Nov. 29, 1996

§ 102(e) Date: Nov. 29, 1996

[87] PCT Pub. No.: WO95/24607

PCT Pub. Date: Sep. 14, 1995

[30] Foreign Application Priority Data

Mar. 10, 1994 [SE] Sweden ..... 9400808

[51] Int. Cl.[6] ..... F42B 5/28; F42B 5/30

[52] U.S. Cl. ..... 102/481; 102/431; 102/466; 102/464

[58] Field of Search ..... 102/481, 430, 102/431, 464, 465, 466, 467, 468

[56] References Cited

U.S. PATENT DOCUMENTS

| | | | |
|---|---|---|---|
| 1,940,657 | 12/1933 | Woodford | 102/465 |
| 2,362,738 | 11/1944 | Yarbrough | 102/464 |
| 3,882,778 | 5/1975 | Gawlick et al. | 102/466 |
| 4,084,512 | 4/1978 | San Miguel | 102/103 |
| 4,458,482 | 7/1984 | Vetter et al. | 60/253 |
| 4,615,270 | 10/1986 | Bell | 102/289 |
| 4,681,038 | 7/1987 | Washburn | 102/464 |
| 5,035,182 | 7/1991 | Purcell et al. | 102/481 |
| 5,048,423 | 9/1991 | Garrett | 102/430 |
| 5,228,285 | 7/1993 | Van Name et al. | 102/481 |
| 5,309,842 | 5/1994 | Matysik et al. | 102/464 |
| 5,404,813 | 4/1995 | Wong | 102/289 |

FOREIGN PATENT DOCUMENTS

| | | | |
|---|---|---|---|
| 0 559 436 | 9/1993 | European Pat. Off. . | |
| 557101 | 8/1923 | France | 102/464 |
| 54858 | 12/1950 | France | 102/430 |
| 1034881 | 8/1953 | France | 102/464 |
| 2627272 | 8/1989 | France . | |
| 306475 | 2/1920 | Germany | 102/464 |
| 958182 | 2/1957 | Germany | 102/464 |
| 1232046 | 1/1967 | Germany | 102/444 |
| 13742 | of 1910 | United Kingdom | 102/464 |

OTHER PUBLICATIONS

English Translation of Roy (54858).
English Translation of Weib et al. (306 475).
English Translation of Bavnier (557 101).
English Translation of Gruner et al. (958 182).
English Translation of Forir (1034 881).
English Translation of Stadler et al. (1 232 046).

*Primary Examiner*—Stephen M. Johnson
*Attorney, Agent, or Firm*—Pollock, Vande Sande & Amernick

[57] ABSTRACT

A cartridge case for service ammunition is designed to reduce the damage effect on the environment in the event of an extreme pressure increase in the propellent powder forming part of the charged ammunition, upon accidental ignition of the propellent powder and to a method for reduction of the damage. The cartridge case comprises at least one longitudinal weakening in the case material, the weakening being designed in such a manner that the case material, when the case is supported by the cartridge chamber of the weapon during the combustion of the powder, withstands stresses from the internal gas pressure, but breaks under the same gas pressure if the propellent powder is ignited when the case is located outside the cartridge chamber, thus splitting open along the weakening.

16 Claims, 2 Drawing Sheets

CASED AMMUNITION

FIELD OF THE INVENTION

The present invention relates to a method and arrangement intended to impart to fixed service ammunition for barrel weapons, for example charged with so-called LOVA powder, such properties that allow to limit to the greatest possible extent the damage to the environment in the event of a hit on or other damage to an ammunition store containing such ammunition which produces a subsequent ammunition fire or other increase in pressure in the ammunition. The arrangement included in the invention is constituted by a cartridge case designed to accomplish the above.

BACKGROUND OF THE INVENTION

LOVA powder is the general designation for a relatively new type of powder including fine-particle crystalline explosive substances. LOVA powders are best thought of as insensitive replacements for the conventional nitrocellulose powders. In the development of LOVA powders, efforts have therefore been made to produce powders which under non-pressurized conditions have burning properties which are as calm as possible but during combustion at high pressure have at least equally good propellent properties as the nitrocellulose powders which they are intended to replace. The designation LOVA stands for "low vulnerability ammunition" and in Swedish specialist texts the designation "l ågkänslig ammunition" {insensitive ammunition} is sometimes seen for this type of product.

The great pressure-sensitivity of LOVA powders as far as their own burning speed is concerned means that there would be much to gain if it were possible to rapidly reduce the pressure in a LOVA powder which has accidentally been ignited, for example by a shell hit on such an ammunition store. By means of such a pressure reduction, it would thus be possible to radically to change the course of events from a runaway combustion, which within a very short period of time would lead to the ammunition store explosion, to a relatively calm combustion.

In particular as far as fixed ammunition is concerned, where the powder is enclosed in sealed cases made of metal, plastic or in certain instances combustible material, it is, however, a matter of considerable difficulty, in the event of an ammunition fire, to bring about a sufficiently rapid pressure reduction within each charge to prevent these individually and the ammunition store as a whole from exploding. It is also relevant that the problem with an ammunition fire can be assumed to apply to vehicles, example, tanks, armoured vehicles, ships, and the like where space is always very restricted. It must moreover be possible for the pressure reduction to take place automatically without any personnel being involved. Moreover, and perhaps most important of all, any measure taken must not in the least endanger the function of the ammunition in its regular use.

SUMMARY OF THE INVENTION

According to the present invention, the abovementioned problems have now been solved by providing the cartridge cases with longitudinal, accurately adapted weakenings. The weakenings are designed in such a manner that they do not jeopardize the functioning of the ammunition on firing with the weapon in question by the case then being supported from the outside by the cartridge chamber of the weapon, but which, in the event of an ammunition fire when the ammunition is outside the cartridge chamber of the weapon, as a result of the pressure increase within the respective case when the powder inside the same is ignited, result in at least one well-defined longitudinal splitting open per case with an open area of such a size that the powder is combusted more calmly and is thus prevented from exploding. In particular as far as ammunition charged with LOVA powder is concerned, which thus in itself burns quite calmly when it is not pressurized; the gains in the form of reduced damage to the environment thus become considerable. The weakening according to the invention is not merely to be designed in such a manner that the split which is opened is sufficiently large to prevent further pressure increases in the powder, but the splitting is to take place at such an early stage that the shells fitted in the respective cases preferably continue to remain in the respective case or at least are not imparted such a speed that they precisely by virtue of this increase the arising damage.

The longitudinal material weakenings which are characteristic to the present invention can be produced in a number of different ways. The main characteristic of these material weakenings is that they are to be locally defined in such a manner as to function primarily as fracture indications. Thus, if the internal pressure rises above a predetermined value without the case being supported on the outside by the cartridge chamber of the weapon in question, the case will be split open more or less as if a longitudinal opening was being opened along a relatively large part of the length of the case. As will be easily understood, this produces a very rapid pressure reduction inside the burning powder which subsequently will continue to burn, and with great intensity at that if it consists of nitrocellulose powder, but more like a stearin candle if it consists of LOVA powder.

As an example of different ways of producing the. weakenings which are characteristic of the invention, external or internal working can be mentioned, in which a part of the material thickness in the case is reduced locally or the material is in another way subjected to a locally delimited, well-defined weakening which produces the corresponding fracture indication. It is most often expedient to end the longitudinal weakenings with a transverse fracture indication which, for example, with weakenings produced by mechanical working, can consist of a sharp edge transverse to the main direction of the longitudinal weakenings. Such a laterally directed fracture indication will ensure that the cases are split open precisely in the form of the openings indicated above. Such laterally directed weakenings can also of course be produced in any other way which can be applied in order to produce the longitudinally directed main weakenings or by using a combination of a number of these methods. Other ways of producing these weakenings are thus soft-annealing which can be an excellent method on metal cartridge cases and which can be carried out with a delimited open flame, with a laser, with an electric arc or by use of induction coils. As far as cartridge cases made of metals with differing hardenability are concerned, it is also possible to locally vary the hardness of the material by isostatic working of the material in the cases so that the desired fracture indications are obtained. The abovementioned methods can moreover be combined with one another. As far as cartridge cases made of plastic and cartridge cases made of combustible material, but also metal cases, are concerned, the weakenings according to the invention can be incorporated into the cases directly during their manufacture by a variation of the material thickness in the case walls for example, in the form of internal grooves with a small radius, a V-shape or other appearance. There are certainly also other methods of producing the weakenings which are characteristic of the invention but, since the weakenings themselves are important, the methods of producing these are of lessor significance.

According to the invention, there is to be at least one weakening, characteristic of the invention, per cartridge case but as a rule it is probably preferable to provide each case with a number of such weakenings even though practical tests have shown that it is only one weakening per case which is activated. Another question which does not have a general answer is how long these weakenings are to be in relation to the case length. Preferable the weakenings should extend along at least half the case length. Since different artillery pieces have cartridge cases of greatly varying thickness and shape, the length and the number of weakenings per cartridge case must nevertheless be determined by practical fire tests.

Both the method and the arrangement according to the invention have been defined in the following patent claims, but the invention is also to be described in somewhat greater detail in association with the attached figures, in which:

DETAILED DESCRIPTION OF THE PREFERRED EMBODIMENT(s)

Figure 2:
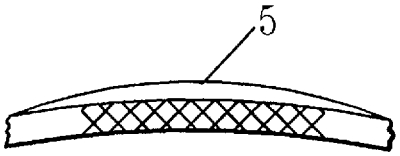
FIG. 2 and FIG. 3 show a cross-section and longitudinal section on enlarged scale of the ends of the weakening bands which are characteristic of the invention.
Figure 3:
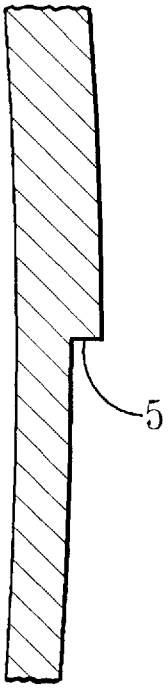
Figure 1:
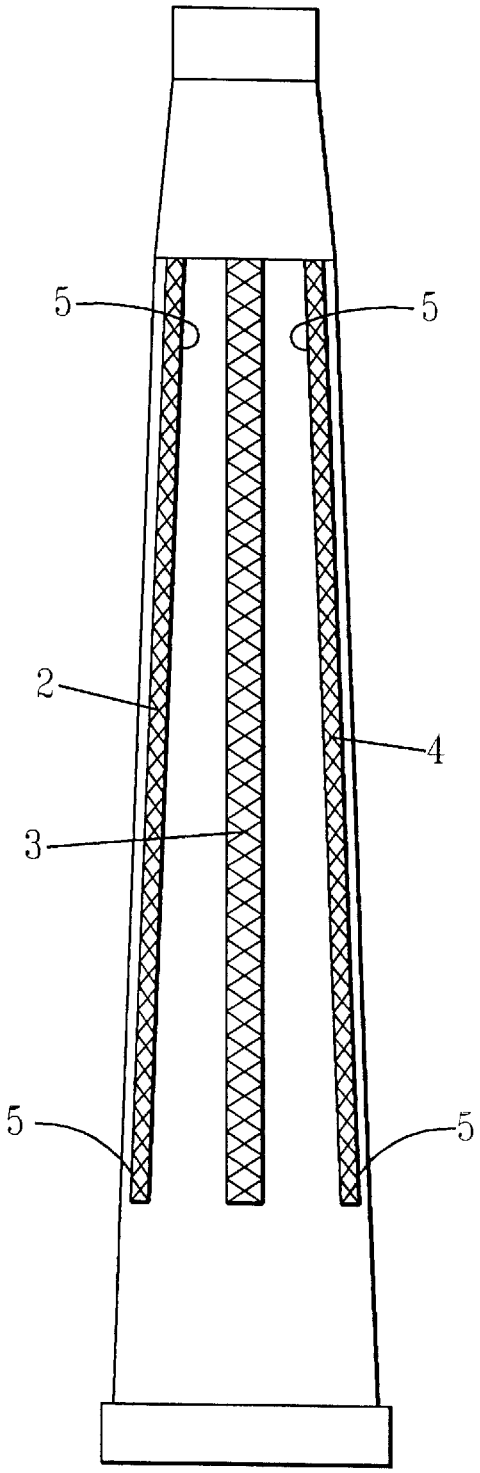
FIG. 1 shows a side projection of a cartridge case for an anti-aircraft automatic cannon designed in accordance with the invention.

The cartridge case designated as 1 in FIGS. 1–3 is provided with a number of weakening bands, of which 2, 3 and 4 are shown in the figures. In this instance, the weakening bands had been produced by, on the one hand, preliminary soft annealing and, on the other hand, subsequent mechanical working, a part of the material being worked off. As can be seen from FIGS. 2 and 3, approximately a third of the material thickness was worked off within the area where the working off was greatest and the working was ended with the previously mentioned sharp edge which is here designated as 5. As illustrated mainly in FIG. 2, the weakenings are realized as plane workings which, as a result of the circular cross-section of the case, produce a material thickness which is successively smaller and smaller towards the central line of the weakening.

Figure 4:
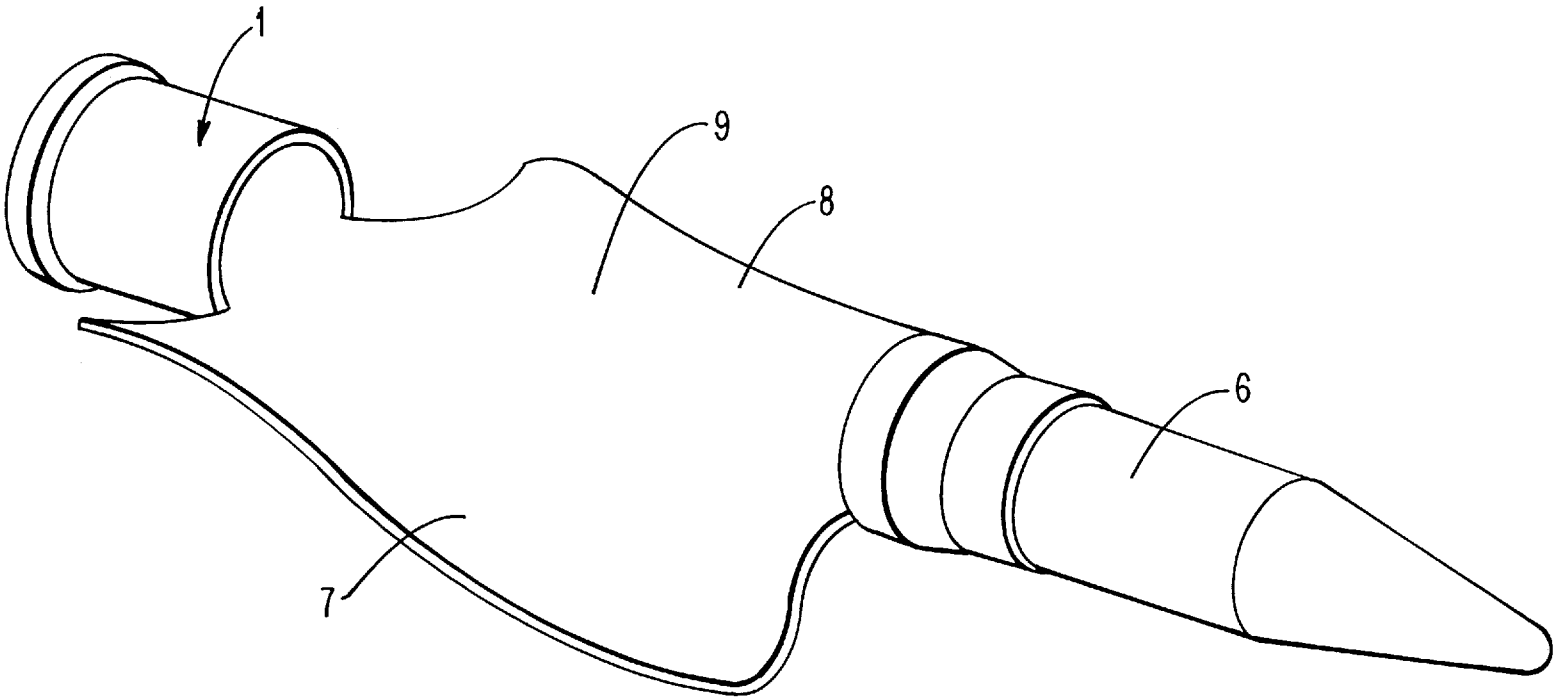
FIG. 4 shows a cartridge designed in accordance with the invention including the case from FIG. 1 after it has been subjected to a fire test.

In FIG. 4, the case 1 from FIGS. 1–3 is accordingly shown, here provided with a fitted shell 6 and after it has, together with its propellent charge of LOVA powder, been subjected to a fire test. In this connection, the propellent powder has been ignited and the increased internal powder gas pressure at 9 has split open the case along the weakening band 2. The sharp edges 5 ending each end of this band have, in this connection functioned as fracture indications which have caused the splits also to go out towards the sides which has made the whole split come to comprise easily half the circumference of the opening. In this connection, split-open opening halves 7 and 8 have been formed, one on each side of the weakening band. As seen in FIG. 4, the shell 6 remained in its place in this instance, as is desired.

We claim:

1. A method used in fixed service ammunition for reducing the damage effect on the environment in the event of extreme pressure increases in the propellent charges of the ammunition, upon accidental ignition and fire in the propellent powder included in the ammunition, said method comprising the steps of:

providing each cartridge case surrounding said propellent powder with at least one longitudinal material weakening;

designing said weakening so as to cause, upon an internal pressure increase in the case brought about by ignition of the propellent powder while the case is without external support in the cartridge chamber of a weapon, breaking of the case along the weakening thus resulting in a splitting open of the case material, said splitting being sufficiently large to prevent an explosion of the propellent powder and to impart a calm or subsiding combustion.

2. A method according to claim 1, wherein said weakenings are designed to cause the cases to split open before the shells fitted in the respective cases are forced out of the case neck by the internal powder gas pressure.

3. A method according to claim 1, wherein said material weakenings in the cases are produced by soft annealing.

4. A method according to claim 3, wherein said soft annealing is produced by use of laser on the case material.

5. A method according to claim 3, wherein said soft annealing is produced by use of electric arc.

6. A method according to claim 1, wherein said material weakenings in the cases are produced by heating said material with open flame.

7. A method according to claim 1, wherein said material weakenings are produced by heating said case material with an induction coil.

8. A method according to claim 1, wherein said material weakenings in the case are produced by making the case material thinner within the area where the weakening is desired.

9. A method according to claim 1, wherein said material weakenings in the cases are produced by an external isostatic working of the case material.

10. A method according to claim 1, wherein said material weakenings are carried out as a combination of at least two of the methods including soft annealing, external or internal working of material and external and/or internal isostatic working of the case material.

11. A method according to claim 1, wherein the longitudinal material weakenings are terminated at their respective ends with fracture indications extending at right angles on either side of the respective longitudinal weakening.

12. A cartridge case for service ammunition designed to reduce the damage effect on the environment in the event of an extreme pressure increase in LOVA propellent powder forming part of the charged ammunition, upon accidental ignition of the LOVA propellent powder, said cartridge case comprising:

at least one longitudinal weakening in the case material, the weakening being designed in such a manner that the case material, when the case is supported by the cartridge chamber of the weapon during the combustion of the LOVA propellant powder, withstands stresses from the internal gas pressure, but breaks under the same gas pressure if the LOVA propellent powder is ignited when the case is located outside said cartridge chamber, thus splitting open along the weakening.

13. A cartridge case according to claim 12, wherein said weakening includes at least one well delimited band which is narrow in relation to the width of the case and extends along the length of the case.

14. A cartridge case according to claim 13 wherein said at least one weakening band extend more than half the length of the case.

15. A cartridge case according to claim 13, wherein each weakening band terminates at its respective ends with a fracture indication in the form of a sharp edge which extends transversely to the longitudinal direction of the weakening band.

16. The cartridge case according to claim 12, wherein upon splitting said weakening is sufficiently large to prevent an explosion of the LOVA propellent powder and to impart a calm or subsiding combustion.

* * * * *